US009205696B2

(12) United States Patent
Young

(10) Patent No.: US 9,205,696 B2
(45) Date of Patent: Dec. 8, 2015

(54) GRIP POSITIONING DEVICE

(71) Applicant: YOUNG OCCUPATIONAL THERAPY ASSESSMENT AND INTERVENTION PRODUCTS, L.L.C., Park City, UT (US)

(72) Inventor: Mary Rose Young, Park City, UT (US)

(73) Assignee: YOUNG OCCUPATIONAL THERAPY ASSESSMENT AND INTERVENTION PRODUCTS, L.L.C., Park City, UT (US)

( * ) Notice: Subject to any disclaimer, the term of this patent is extended or adjusted under 35 U.S.C. 154(b) by 130 days.

(21) Appl. No.: 13/873,034

(22) Filed: Apr. 29, 2013

(65) Prior Publication Data

US 2013/0287469 A1 Oct. 31, 2013

Related U.S. Application Data

(60) Provisional application No. 61/639,278, filed on Apr. 27, 2012.

(51) Int. Cl.
*B43K 23/012* (2006.01)
*B43K 23/004* (2006.01)

(52) U.S. Cl.
CPC ..... *B43K 23/012* (2013.01); *B43K 23/004* (2013.01)

(58) Field of Classification Search
CPC ..... B43K 23/012
USPC ..... 401/6, 8
See application file for complete search history.

(56) References Cited

U.S. PATENT DOCUMENTS

| | | | | | |
|---|---|---|---|---|---|
| 147,930 | A | | 2/1874 | Galland | |
| 198,484 | A | * | 12/1877 | Briggs | 401/8 |
| 235,520 | A | * | 12/1880 | Forsyth | 15/443 |
| 310,771 | A | | 1/1885 | Anderson | |
| 423,587 | A | | 3/1890 | Barter | |
| 471,556 | A | | 3/1892 | Jolly | |
| 500,564 | A | | 7/1893 | Dierlamm | |
| 665,561 | A | * | 1/1901 | Anderson | 401/8 |
| 784,970 | A | * | 3/1905 | Williams | 215/12.1 |
| 1,313,723 | A | * | 8/1919 | Mullally | 15/244.1 |
| 1,702,660 | A | | 2/1929 | Mockel | |
| 2,202,957 | A | * | 6/1940 | Martin | 401/8 |
| 2,273,044 | A | | 2/1942 | Johnson | |
| 2,709,419 | A | | 9/1954 | Appel | |
| 3,019,769 | A | | 7/1959 | Ballard | |
| 3,402,984 | A | | 9/1968 | Zazzara | |
| 3,629,867 | A | * | 12/1971 | Taylor | 2/160 |
| 3,666,372 | A | | 5/1972 | Lipkowski | |
| 4,846,710 | A | | 7/1989 | Campbell | |
| 5,310,345 | A | | 5/1994 | Gershon | |
| 6,009,882 | A | * | 1/2000 | Schine et al. | 132/200 |

(Continued)

*Primary Examiner* — David Walczak
*Assistant Examiner* — Joshua Wiljanen
(74) *Attorney, Agent, or Firm* — Kunzler Law Group, PC

(57) ABSTRACT

The present disclosure relates to a grip positioning device that includes a tool receptacle that forms a loop, the loop delineating a tool opening through which a tool may be extended, and a plurality of digit receiving elements each forming a loop, the loops each delineating a finger opening through which a digit of a user may be extended, the digit receiving elements coupled to and positioned about the tool receptacle. The tool receptacle and the digit receiving elements may be constructed from a unitary piece of material and the grip positioning device may further include separators that partition the digit receiving elements from the tool receptacle.

24 Claims, 8 Drawing Sheets

(56) References Cited

U.S. PATENT DOCUMENTS

| | | | | |
|---|---|---|---|---|
| 6,237,194 | B1 | 5/2001 | Williams | |
| 6,669,388 | B1 * | 12/2003 | Short | 401/8 |
| D509,320 | S * | 9/2005 | Shefsky et al. | D28/41 |
| 7,478,768 | B2 * | 1/2009 | Yip | 239/529 |
| 7,794,163 | B2 | 9/2010 | Bush, III et al. | |
| 8,146,968 | B1 * | 4/2012 | Starr | 294/25 |

* cited by examiner

GRIP POSITIONING DEVICE

CROSS-REFERENCE TO RELATED APPLICATION

This application claims the benefit of U.S. Provisional Patent Application No. 61/639,278, entitled "Writing Assistance Device" and filed on Apr. 27, 2012 for Mary Rose Young, which is incorporated herein by reference.

FIELD

This patent application is in the field of grip positioning devices for improving an individual's grip on a tool, such as a writing implement or a utensil.

BACKGROUND

Some children and individuals with disabilities, when first learning how to handle writing implements or utensils ("tools"), struggle with holding a tool in an appropriate manner. For example, a child may be unable to grip a pencil, may hold the pencil by forming a fist, or may use a variation of another immature and inefficient grasp to hold and manipulate the pencil. A variety of devices have been developed in the past to help a child improve his or her grip; however, these devices have various shortcomings and generally fail to comfortably and conveniently promote proper grip positioning techniques.

SUMMARY

The subject matter of the present disclosure has been developed in response to the present state of the art, and in particular, in response to the problems and needs in the art that have not yet been fully solved by currently available grip positioning devices. Accordingly, the subject matter of the present disclosure has been developed to provide an apparatus, system, and method for assisting users in handling tools that may overcome many or all of the above-discussed or other shortcomings in the art.

The present disclosure relates to a grip positioning device that includes a tool receptacle that forms a loop, the loop delineating a tool opening through which a tool may be extended, and a plurality of digit receiving elements each forming a loop, the loops each delineating a finger opening through which a digit of a user may be extended, the digit receiving elements coupled to and positioned about the tool receptacle. According to one embodiment, the digit receiving elements may each have a single finger opening and there may be three digit receiving elements. Additionally, the tool receptacle and the digit receiving elements may be constructed from a unitary piece of material and the grip positioning device may further include separators that partition the digit receiving elements from the tool receptacle. For example, the separators may cinch down on the unitary piece of material to partition the digit receiving elements from the tool receptacle.

In one embodiment, the grip positioning device may be constructed from multiple pieces of material that are fastened together. For example, the multiple pieces of material may be interwoven to form the tool receptacle and the digit receiving elements. Additionally, the multiple pieces of material may be constructed from different types of material. According to one embodiment, the grip positioning device may be constructed from a plastic, polymer, silicone, rubber, cloth, or fabric type of material that is resiliently flexible. In another embodiment, each digit receiving element may be independently pliable relative to the others. Also, the thickness of the tool receptacle may be greater than the thickness of the digit receiving elements.

In another embodiment, the grip positioning device may include a gripping material on an inner surface of the tool receptacle and/or a gripping material on inner surfaces of the digit receiving elements. The cross-sectional areas of the tool opening and the finger openings may be expandable and collapsible and the openings may be substantially coplanar. According to one embodiment, the grip positioning device may include a tool receptacle that delineates a tool opening through which a tool may be inserted, three digit receiving elements that delineate three finger openings through which three of a user's digits may be inserted, the digit receiving elements comprising the same piece of material as the tool receptacle but extending out from the tool receptacle, and three separators that demarcate the three digit receiving elements from the tool receptacle.

The present disclosure also includes details relating to a method of using a grip positioning device. According to one embodiment, the method includes inserting a tool into a tool opening of a tool receptacle, inserting a first digit of a user into a finger opening of a first digit receiving element, inserting a second digit of a user into a finger opening of a second digit receiving element, and inserting a third digit of a user into a finger opening of a third digit receiving element, wherein each of the first, second, and third digit receiving elements are fastened to and extend out from the tool receptacle.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter of the present disclosure will be readily understood, a more particular description of the subject matter briefly described above will be rendered by reference to specific embodiments that are illustrated in the appended drawings. Understanding that these drawings depict only typical embodiments of the subject matter of the present disclosure and are not therefore to be considered to be limiting of its scope, the subject matter will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Illustrated in FIGS. 1-7 are several representative embodiments of a grip positioning device. As described herein, the grip positioning device provides several significant advantages and benefits over other approaches. However, the recited advantages are not meant to be limiting in any way, as one skilled in the art will appreciate that other advantages may also be realized upon practicing the present disclosure.

Figure 1:
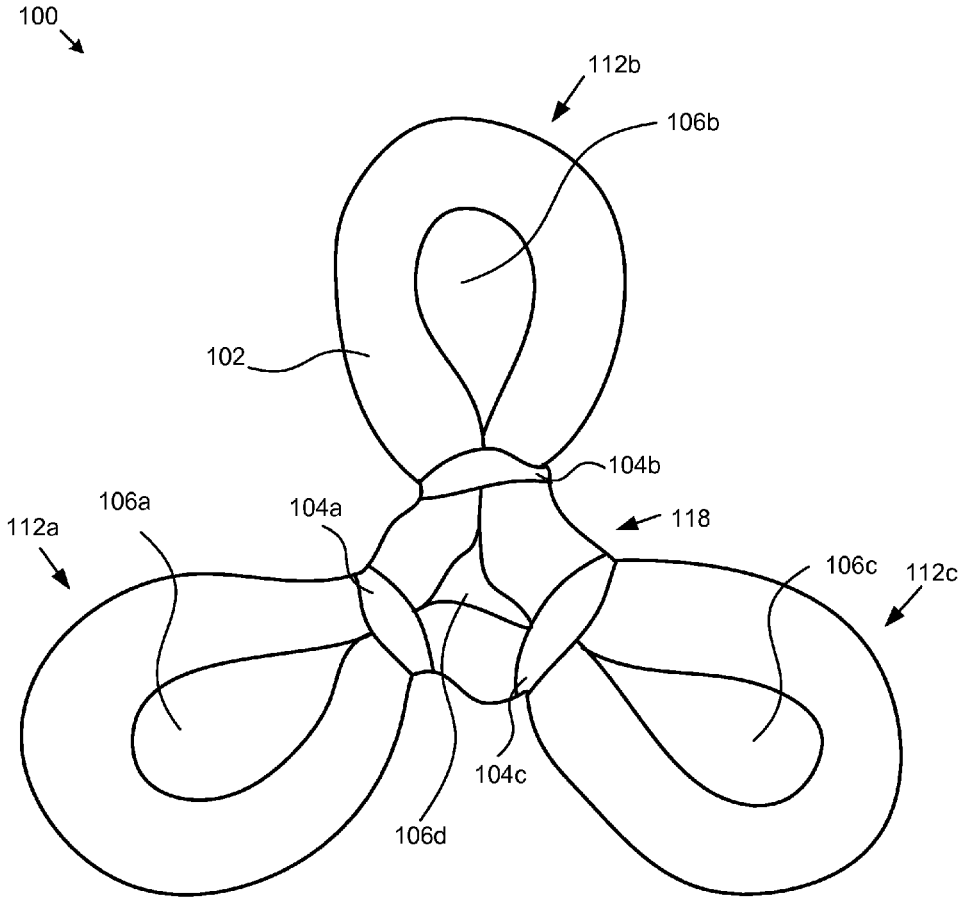
FIG. 1 is a top view of a first embodiment of a grip positioning device.

FIG. 1 illustrates a first embodiment of a grip positioning device 100. In the embodiment shown in FIG. 1, the body 102 of the grip positioning device 100 is formed from a single band. The depicted grip positioning device 100 also includes fasteners 104*a-c*, which couple portions of the body to itself to form respective finger openings 106*a-c* and a tool opening 106*d*.

In one embodiment, the body 102 is made from an elastic material. The body 102 is the main physical structure of the grip positioning device 100. The body 102 may be formed from a band. As used herein, a band refers to a relatively thin strip of material. The body 102 may be made from a flexible material that is easily bent without breaking. The body 102 may be made from an elastic material that can be stretched, compressed, or deformed, and which returns to its original shape. Accordingly, in some implementations, the body 102 is made from a resiliently flexible material. In one embodiment, the body 102 is an elastic fabric, such as is commonly used for hair bands. In another embodiment, the body 102 is made from a polymeric material, such as polyurethane. The body 102 may also be made from silicone, rubber, or other suitable materials. In certain embodiments, the body 102 may be formed via a molding process. As shown in FIG. 1, the body 102 may be, in certain embodiments, a continuous strip or length of material. In one implementation, the body 102 is formed from an annular band of resiliently flexible fabric that is pinched at three respective locations via the fasteners 104*a-c* to form the openings 106*a-d*.

Referring to FIG. 1, the fasteners 104*a-c* divide the body into the one or more separate and distinct openings 106*a-d*. In one embodiment, each of the fasteners 104*a-c* may include string that connects or couples two opposing sections of the body 102 together to form an opening 106. The fasteners 104*a-c* may form a mechanical connection that divides the body 102, such as string, a staple, or a D-ring rectangular loop to maintain their relative positions. In some implementations, the fasteners 104*a-c* may form a chemical bond, such as a chemical adhesive (e.g., glue) that connects the sections of the body 102 together.

The openings 106*a-d* are apertures defined by the body 102. The openings are through-openings with open ends at both sides of the body 102, allowing fingers extend through the openings 106*a-c* and a tool (such as a pencil, pen, or utensil) to pass through the opening 106*d*. In one embodiment, the finger openings 106*a-c* and the tool opening 106*d* may be substantially coplanar, at least when the device is in a natural/relaxed state (i.e., when the device is not in use).

The portion of the body 102 of the grip positioning device 100 defining the opening 106*d* is defined as a tool receptacle 118. The receptacle 118 can be positioned proximate a center of the grip positioning device 100 as seen in FIG. 1. The tool receptacle 118 may be configured to receive a tool such as a pen, pencil, or utensil. The tool receptacle 118 may be formed by three fasteners 104*a-c*, as shown in FIG. 1, or fewer or more than three fasteners. The tool receptacle 118 may be a "hub", with three "spoke" digit receiving elements 112*a-c* that extend outward from the tool receptacle 118. In one embodiment, the tool receptacle 118 may have a substantially triangular shape. The digit receiving elements 112*a-c*, according to one embodiment, may be independently flexible or pliable relative to each other. For example, the digit receiving elements 112*a-c* may each form a loop that delineates the finger openings 106*a-c* through which a digit of a user may be extended. Similarly, the tool receptacle 118 may form a loop that delineates the tool opening 106*d* through which a tool may be extended.

In certain embodiments, the opening 106*d* of the tool receptacle 118 may be smaller in size than the openings 106*a-c* of the digit receiving elements 112. The tool opening 106*d* may also have a different shape than the finger openings 106*a-c* of the digit receiving elements 112. The tool opening 106*d*, in its unflexed state, may be sized to be smaller than the diameter of most tools. The tool receptacle 118 may flex when the tool is inserted therein, thus providing additional force on the sidewalls of the tool, and improving the ability of the tool receptacle 118 to removably retain the tool therein. The openings 106*a-c* of the digit receiving elements 112*a-c* may also be, in an unflexed state, sized smaller than or to the size of the diameter of the average finger size of a user. The digit receiving elements 112*a-c* may flex when digits are inserted therein, which provides enough restriction to keep the user's digits in a proper position when grasping the tool.

The tool receptacle 118 may be made of the same material as the digit receiving elements 112, such as when the body 102 is made from single length of continuous material or fabric. In other embodiments, the tool receptacle 118 is made from a material that is different from the material of the digit receiving elements 112. For example, the tool receptacle 118 may be made from a material with a higher friction coefficient in order to provide increased grip of the tool. The tool receptacle 118 may be formed from a material with less elasticity to similarly provide a tighter fit (e.g., enhanced grip) of the tool within the receptacle. The digit receiving elements 112, in contrast, may be made from a material that provides greater flexibility to accommodate a wider range of finger sizes and positions. The digit receiving elements 112 may be made from an elastic fabric with a relatively higher elasticity in order to provide a more comfortable fit with the fingers of the user. Additionally, the digit receiving elements may be made from a stiffer yet flexible material to accommodate a greater range of disabilities, giving consideration to circulatory concerns and independence in donning and doffing. In some embodiments, to enhance the grip of the receptacle 118 on a tool, the interior facing surfaces of the receptacle defining the opening 106*d* may be coated with a friction-enhancing material, such as a rubber or other polymeric material.

Figure 2:
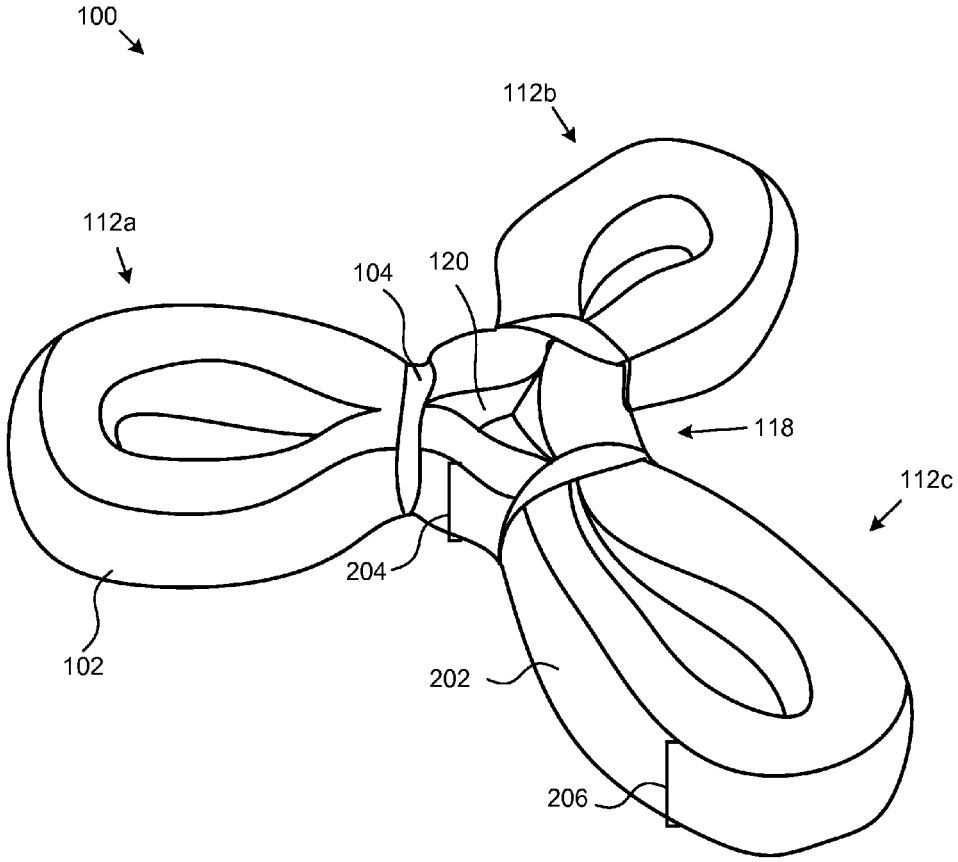
FIG. 2 is a perspective view of the grip positioning device of FIG. 1.

In certain embodiments, the digit receiving elements 112*a-c* and the tool receptacle 118 have a thickness 204, as labeled in FIG. 2. The thickness 204 of the tool receptacle 118 may be the same thickness as the digit receiving elements 112*a-c*. In other embodiments, the thickness 204 of the tool receptacle 118 may be greater than the thickness 206 of the digit receiving elements 112*a-c*. In such embodiments, the tool receptacle 118 may extend along some portion of the length of the tool. For example, certain grip positioning devices 100 may have a receptacle 118 with a triangular-shaped grip that fits over a substantial portion of the end of a tool. The triangular-shaped grip helps guide the user's fingers into a proper position on the tool. In certain embodiments, the tool receptacle 118 may include a triangular shape grip. The user may still insert her digits into the digit receiving elements 112, but has the additional triangular shape grip to guide the user's grip. Other grip guidance devices may also be incorporated into the tool receptacle 118.

The openings 106*a-c* are defined by respective digit receiving elements 112*a-c*, and receive and engage the tool-gripping fingers of the user. The digit receiving elements 112*a-c* may have a variety of shapes, depending on the needs of the user. In one embodiment, such as shown in FIG. 1, each digit receiving elements 112*a-c* defines an interior opening that is substantially oval-shaped. In other embodiments, the digit receiving elements 112*a-c* may each define an interior opening that is circular in shape. Other shapes may also be used. The exterior of the digit receiving elements 112*a-c* may be similarly shaped to match the shape of the respective openings 106*a-c*. For example, in FIG. 1, the digit receiving elements 112*a-c* each has a substantially oval shape. The digit receiving elements 112*a-c* each may form a loop through which the user can pass a respective finger, thereafter grasping the tool that is retained within the opening 106*d*.

Figure 5:
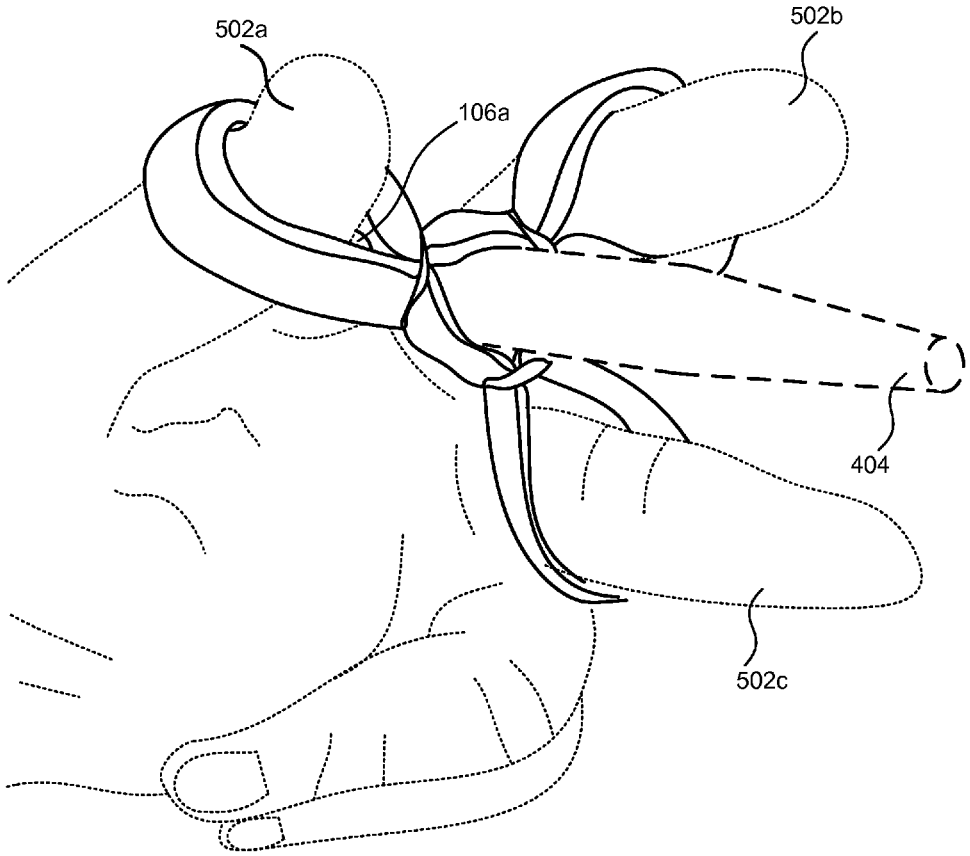
FIG. 5 is perspective view of the grip positioning device of FIG. 1 engaged with a tool and the digits of a user.
Figure 6:
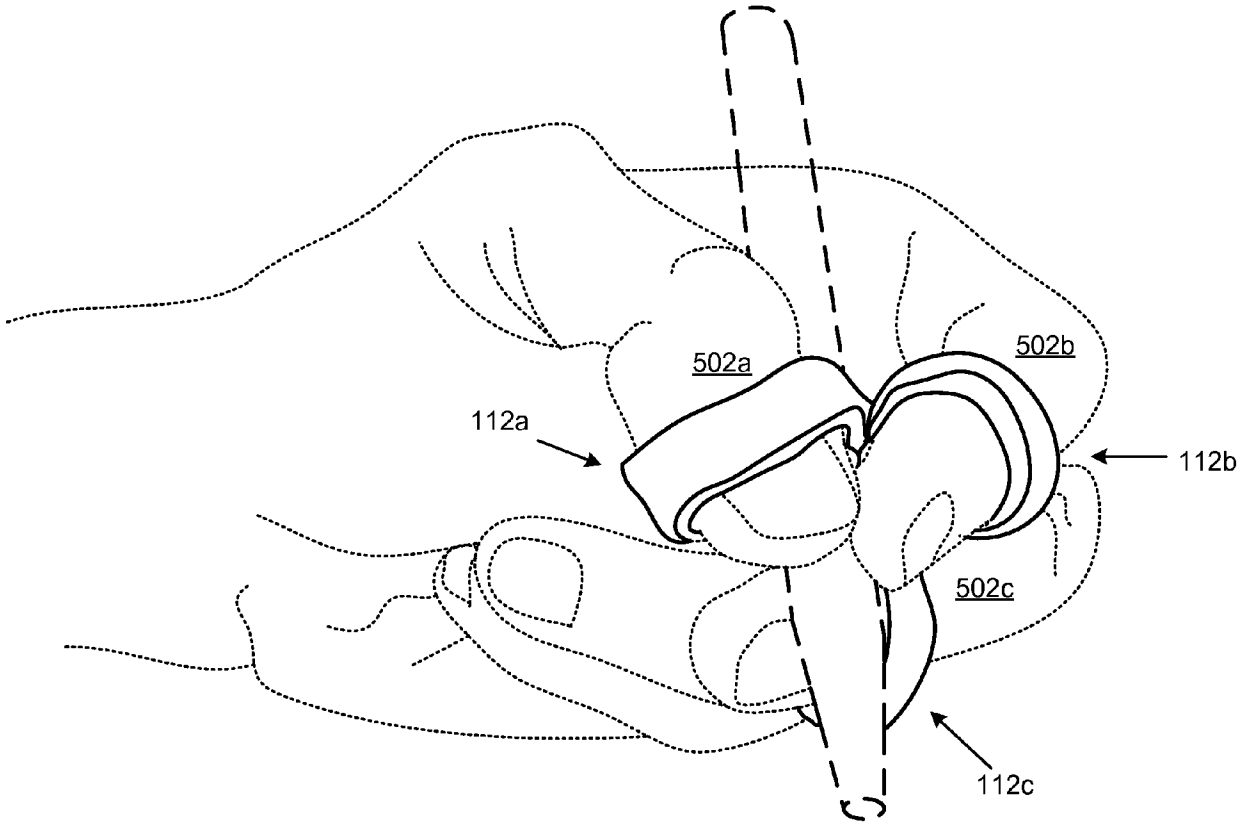
FIG. 6 is another perspective view of the grip positioning device of FIG. 1 engaged with a tool and the digits of a user, where the tool is positioned against a surface in working position.
Figure 8:
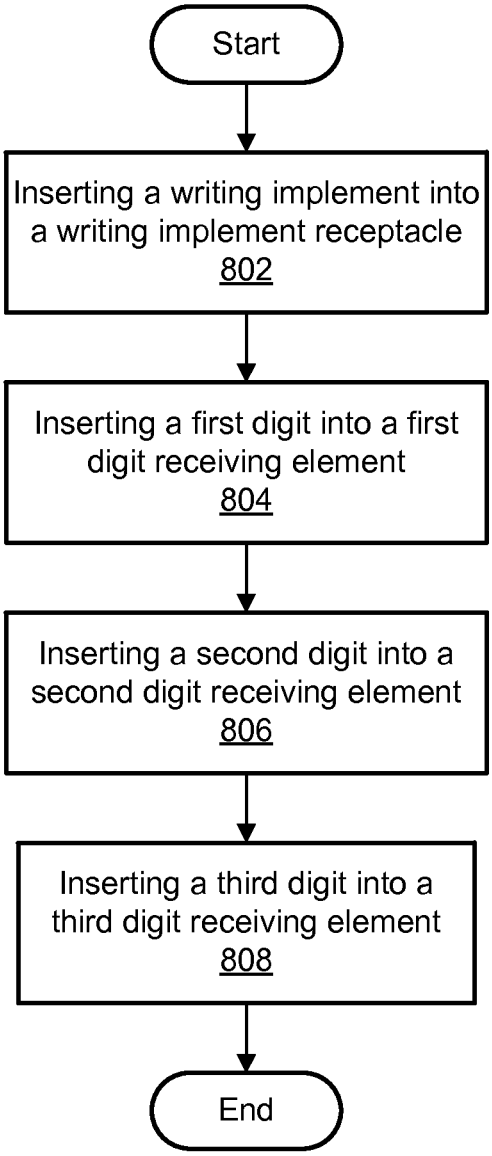
FIG. 8 is a schematic flow chart diagram of one embodiment of a method for using a grip positioning device.

The finger openings 106*a-c* may be configured to receive digits of a user of the grip positioning device 100. The openings 106*a-c* may be configured to allow the thumb, index finger, and middle fingers of the user to extend through the respective openings 106*a-c*. The digits of the user extend through the openings 106*a-c* such that the ends of the digits extend through and out of the openings 106*a-c*, as seen in FIGS. 5, 6, and 8. As a result, the grip positioning device 100 provides sufficient restriction to encourage and support a proper grip, but still allows more flexibility than other grip positioning devices 100.

FIG. 2 shows a second view of the grip positioning device 100. Additionally, FIG. 2 shows a sidewall 202 of the body 102. In certain embodiments, such as shown in FIG. 2, the separators 104 run up the length of the sidewall 202. The separators 104 may form a connection, along the entire length of the sidewall 202, between the tool receptacle 118 and the digit receiving elements 112. Such an implementation may provide for a more robust and durable grip positioning device 100, but still provide sufficient flexibility for the user. The separators 104, according to one embodiment, may function as partitions that cinch down on the body 102 to separate the digit receiving elements 112 from the tool receptacle 118.

FIG. 2 also shows the digit receiving element 112 having a thickness 206, and the tool receptacle 118 having a thickness 204. As discussed above, in certain embodiments, the tool receptacle 118 has a thickness 204 that is greater than the thickness 206 of the digit receiving element 112. In certain embodiments, the tool receptacle 118 may extend farther along the longitudinal axis of the tool than the digit receiving elements 112. The tool receptacle 118 may include a grip guidance section that guides the position of the user's fingers on the tool. The grip guidance section may extend downwards towards the tip of the tool such that the user can insert her fingers into the digit receiving elements 112 and then position the fingers on the grip guidance section. The device may further include a gripping material on the inner surfaces 120 of the tool receptacle 118. The inner surfaces 120 of the tool receptacle 118 are those surfaces that engage the inserted tool. The gripping material may increase the friction between the tool and the device, thus preventing the tool from slipping during use. The gripping material, for example, may include a rubber or silicone strip applied on the inner surfaces of the device. It is also contemplated that gripping material may be applied on the inner surfaces of the digit receiving elements, thereby decreasing slippage between the fingers and the device.

Figure 3:
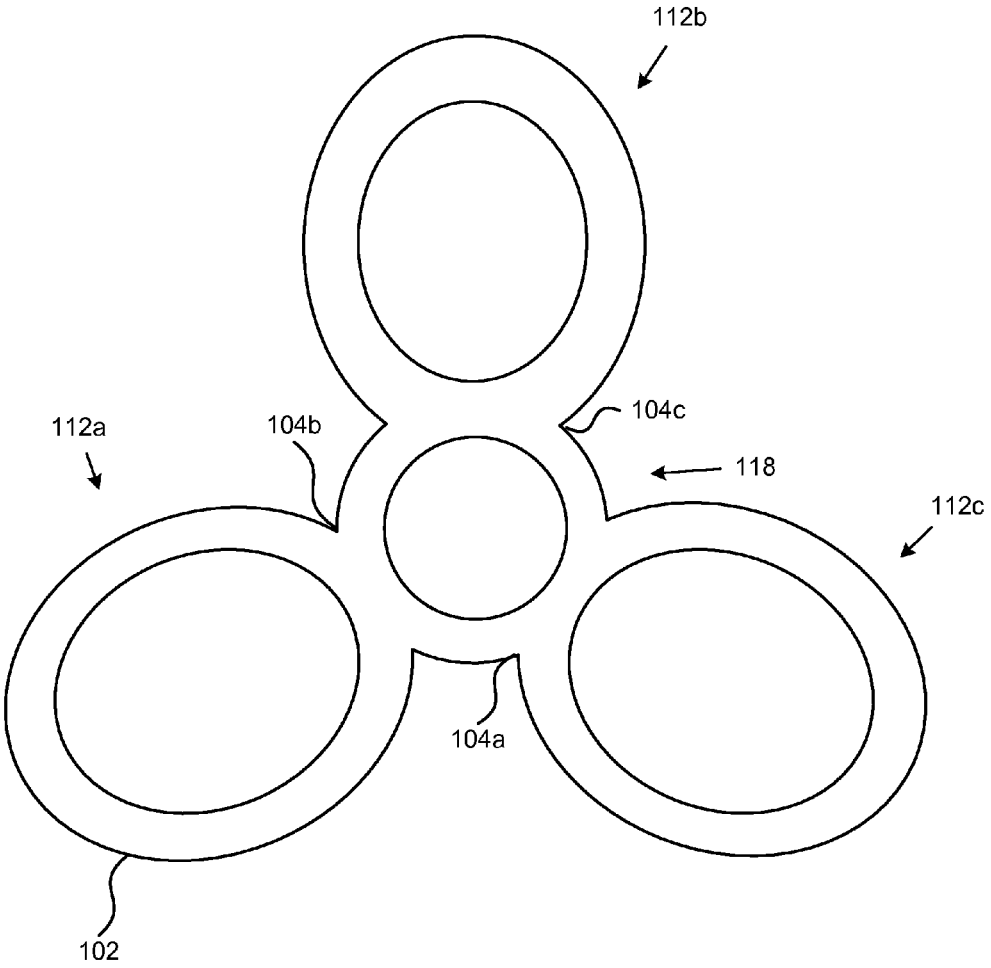
FIG. 3 is a top view of another embodiment of a grip positioning device.

FIG. 3 shows another embodiment of a grip positioning device 100. In the embodiment shown in FIG. 3, the grip positioning device 100 has a unitary body 102. In such an embodiment, the unitary body 102 has portions defined as the digit receiving elements 112*a-c* and a portion defined as the tool receptacle 118. Also, the portions of the body 102 separating the digit receiving elements 112*a-c* from the tool receptacle 118 are defined as the separators 104*a-c*. The grip positioning device 100 may be formed from silicone or other polymeric material. The grip positioning device 100 may be formed by creating a mold substantially in the shape shown in FIG. 3. The grip positioning device 100 may be formed through a molding process, such as an extrusion process or injection molding process, or other approaches for creating structures from silicon, plastic, or other suitable structures. The grip positioning device 100 may be formed of rubber, or other suitably flexible and elastic material.

Figure 4:
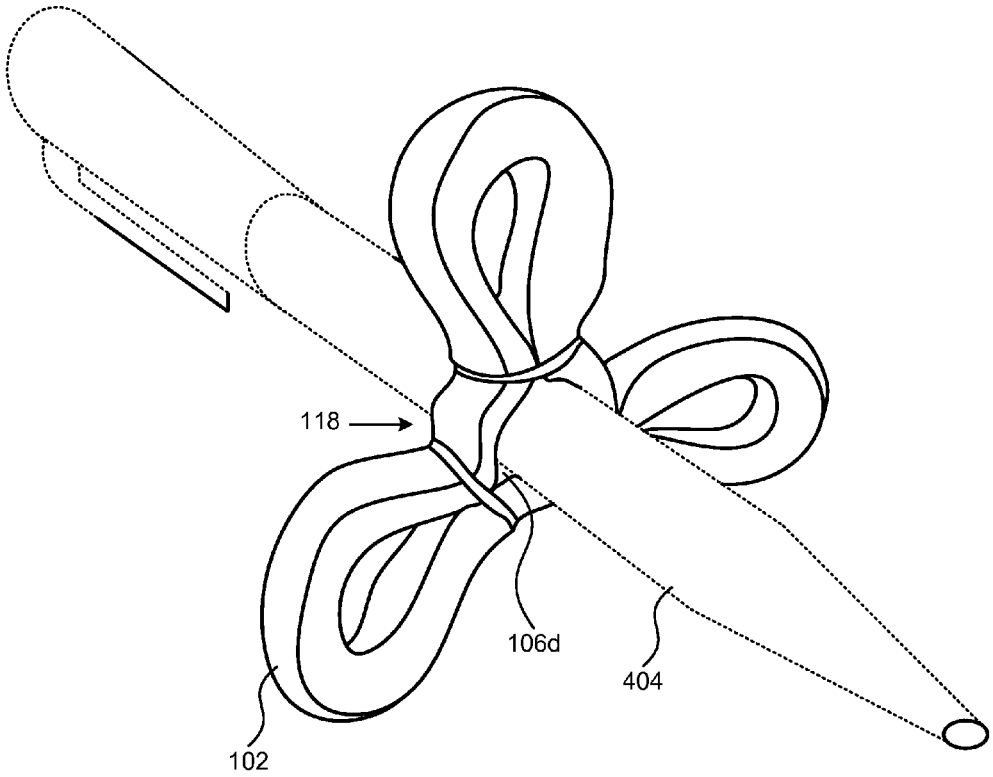
FIG. 4 is a perspective view of the grip positioning device of FIG. 1 engaged with a tool.

FIG. 4 illustrates the grip positioning device 100 with a tool 404 inserted through the opening 106*d* of the tool receptacle 118. While FIG. 4 shows a tool 404 that is a pen, other tools such as pencils, crayons, forks, spoons, paintbrushes, etc., could also be used. As seen in FIG. 4, the tool 404 may be inserted through the opening 106*d*. The user may then insert fingers through the remaining openings 106 in order to grip the tool 404. The grip positioning device 100 may be easily moved up and down the tool 404 to accommodate the user based on hand size, comfort, and other considerations.

FIG. 5 illustrates the grip positioning device 100 with fingers 502 inserted through the openings 106. The term "fingers" is used to refer to the digits on the hand, including the thumb. As in FIG. 4, one opening in the tool receptacle is used to hold the tool 404. The three remaining openings are for the digit receiving elements and are used for the fingers 502 of the user. In one embodiment, one digit receiving element is for the thumb 502*a*, another for the index finger 502*b*, and another for the middle finger 502*c* of the user. The fingers 502 are inserted into one end of the opening of the digit receiving element, and exit the opposite end of the opening.

The digit receiving elements may form loops through which a user may insert his or her fingers, as seen in the previous Figures. According to one embodiment, the user can fully insert her fingers 502 through the openings in the digit receiving elements so that the digit receiving elements are positioned around the distal portion of the fingers. The ends of the fingers 502 are thus free to grasp the tool 404. This may allow for a more natural feel and grip, since the user's fingers 502 are in direct contact with the tool 404.

The digit receiving elements of the body may also be sufficiently flexible to allow for a wide range of positioning. The digit receiving elements may be positioned between the second and third knuckles of the fingers 502. For other users, it may be beneficial to position the digit receiving elements between the first and second knuckles of the fingers 502. The use of digit receiving elements may accommodate both options, providing greater flexibility and the ability to customize the position of the grip positioning device 100.

FIG. 6 illustrates one embodiment of a grip positioning device 100 engaged with a user's hand. FIG. 6 also illustrates the digit receiving elements 112 through which the user inserts fingers 502. Not seen in FIG. 6 is the opening 106*d* through which the tool 404 is positioned. The digit receiving elements 112 provide sufficient restriction to keep the fingers 502 in an appropriate position; however, they also offer sufficient flexibility to allow the user to vary his grip. For example, in FIG. 6, the digit receiving element 112*c* can be adjusted to fit higher on the finger 502*c* allowing the user to place the finger 502*c* behind the tool 404. In another embodiment the user may position the digit receiving elements 112*c* closer to the end of the finger 502*c*, and position the finger 502*c* into a tripod grip, with the tip of the finger 502*c* engaging the tool 404. The use of digit receiving elements 112 that are open at both ends, allowing the fingers to extend through the digit receiving element 112, allows the grip positioning device 100 to work for an adult, as well as a child, by comfortably accommodating a wide range of finger 502 sizes. For example, in order to accommodate various finger sizes and various tool sizes, the cross-sectional areas of the finger openings 106*a-c* and the tool opening 106*d* may be expandable and collapsible.

Figure 7:
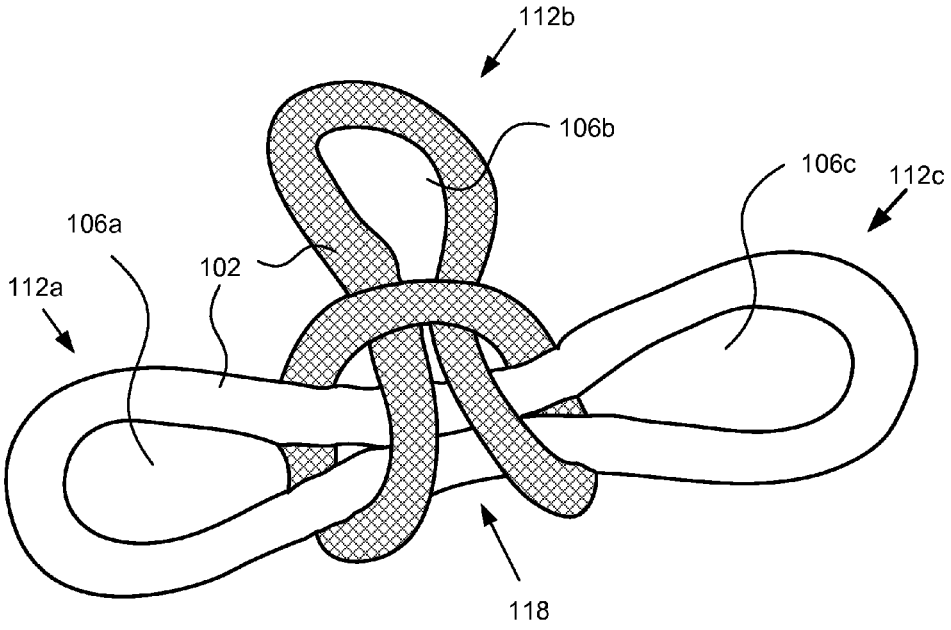
FIG. 7 is a perspective view of another embodiment of a grip positioning device.

FIG. 7 shows another embodiment of a grip positioning device 100. The grip positioning device 100 shown in FIG. 7 comprises a body 102 formed from two pieces of material that are fastened together (e.g., intertwined bands). The two pieces of material may be made from the same type of material or may be constructed of different materials, such as rubber, elastic fabric, or other suitable elastic and flexible material. The two bands may be interwoven or intertwined to form the digit receiving elements 112 and a tool receptacle 118. As above, the tool may be inserted into the opening of the tool receptacle 118, and the fingers of the user into the digit receiving elements 112*a-c*.

The two bands shown in FIG. 7 may be fixed to one another in certain embodiments. The bands may be fixed by a mechanical means; for example, the two bands may be sewn together, stapled together, clamped together, or otherwise affixed to each other to maintain their relative positions. The bands may be affixed by chemical means; for example, the bands may be glued together. The bands may be affixed by some combination of mechanical and chemical means, such as gluing and sewing the bands to each other to fix their positions. The bands may be affixed to one another at one or more points on the bands.

As depicted in FIG. 6, the embodiment of the grip positioning device 100 of FIG. 7 may have a user insert his thumb through the digit receiving element 112*a*, the index finger through the digit receiving element 112*b*, and the middle finger through the digit receiving element 112*c*. The digits, however, need not be inserted through these particular digit receiving elements 112 shown in FIG. 6; for example, the thumb may be inserted through the digit receiving element 112*c*, with corresponding changes made to which digits are inserted through the other digit receiving elements. The flexible nature of the grip positioning device 100 allows for multiple correct configurations when the user inserts his digits through the digit receiving elements 112, making the grip positioning device 100 more intuitive and easy to use. The tool may also be similarly inserted through the tool receptacle 118 and the tool receptacle 118 may be positioned along the length of the tool 404 at a location that is appropriate and comfortable for the user. The user may then begin to use the tool (i.e., may begin to write if the tool is a pen or pencil).

According to one embodiment, the grip positioning device of the present disclosure may also be implemented as a precision grasping element. For example, if a certain application involves handling small items, the digit receiving elements may be positioned on a user's fingers without inserting a tool into the tool receptacle. In such an embodiment, the device may function to support the user's fingers in precisely picking up or handling small items. For example, if a child was learning how to pick up and eat small food items (e.g., cereal), the device of the present disclosure may be used to support the child's fingers in such a manner so as to enable the child to precisely pick up and handle the small food items with the child's fingertips.

FIG. 8 is a schematic flow chart diagram of one embodiment of a method for using a grip positioning device. The method includes inserting 802 a tool into a tool opening of a tool receptacle. For example, a pen may be inserted into the tool opening of the tool receptacle so that it extends through the tool receptacle. The method also includes inserting 804 a first digit of a user into a finger opening of a first digit receiving element, inserting 806 second digit of a user into a finger opening of a second digit receiving element, and inserting 808 a third digit of a user into a finger opening of a third digit receiving element. For example a user may insert his forefinger, middle finger, and thumb into the first, second, and third digit receiving elements, respectively.

In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

The present subject matter may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A grip positioning device, comprising:

a tool receptacle comprising a first resiliently flexible strap that forms a first loop, the first loop defining a tool opening through which a tool may be extended, the tool opening extending along a thickness of the first resiliently flexible strap from a first open end to a second open end;

a plurality of digit receiving elements each comprising a second resiliently flexible strap with each second resiliently flexible strap forming a second loop, each of the second loops defining a finger opening through which a digit of a user may be extended, each finger opening extending along a thickness of a respective second resiliently flexible strap from a third open end to a fourth open end; and separators that partition the digit receiving elements from the tool receptacle;

wherein the digit receiving elements are coupled to and positioned about the tool receptacle, the tool receptacle being centrally located between the digit receiving elements;

wherein the tool receptacle and the digit receiving elements are constructed from a unitary piece of material; and wherein the separators cinch down on the unitary piece of material to partition the digit receiving elements from the tool receptacle.

2. The grip positioning device of claim 1, wherein each digit receiving element defines a single finger opening through which a single digit may be inserted.

3. The grip positioning device of claim 1, wherein the plurality of digit receiving elements comprises at least three digit receiving elements.

4. The grip positioning device of claim 1, wherein the device is constructed from a plastic, polymer, silicone, rubber, cloth, or fabric type of material.

5. The grip positioning device of claim 1, wherein the thickness of the first resiliently flexible strap of the tool receptacle is the same as the thickness of each of the second resiliently flexible straps of the digit receiving elements.

6. The grip positioning device of claim 1, wherein each digit receiving element is independently pliable relative to the others.

7. The grip positioning device of claim 1, wherein the thickness of the first resiliently flexible strap of the tool receptacle is greater than the thickness of each of the second resiliently flexible straps of the digit receiving elements.

8. The grip positioning device of claim 1, further comprising a gripping material on an inner surface of the tool receptacle.

9. The grip positioning device of claim 1, further comprising a gripping material on inner surfaces of the digit receiving elements.

10. The grip positioning device of claim 1, wherein the cross-sectional areas of the tool opening and the finger openings are expandable and collapsible.

11. The grip positioning device of claim 1, wherein the tool opening and the finger openings are substantially coplanar.

12. The grip positioning device of claim 1, wherein the tool opening has a substantially triangular-shaped cross-section.

13. A grip positioning device, comprising:

a tool receptacle comprising a first resiliently flexible strap that forms a first loop, the first loop defining a tool opening through which a tool may be extended, the tool opening extending along a thickness of the first resiliently flexible strap from a first open end to a second open end; and a plurality of digit receiving elements each comprising a second resiliently flexible strap with each second resiliently flexible strap forming a second loop, each of the second loops defining a finger opening through which a digit of a user may be extended, each finger opening extending along a thickness of a respective second resiliently flexible strap from a third open end to a fourth open end;

wherein the digit receiving elements are coupled to and positioned about the tool receptacle, the tool receptacle being centrally located between the digit receiving elements;

wherein the device is constructed from multiple pieces of material that are coupled together; and wherein the multiple pieces of material are interwoven to form the tool receptacle and the digit receiving elements.

14. The grip positioning device of claim 13, wherein the multiple pieces of material are constructed from different types of material.

15. The grip positioning device of claim 13, wherein each digit receiving element defines a single finger opening through which a single digit may be inserted.

16. The grip positioning device of claim 13, wherein the plurality of digit receiving elements comprises at least three digit receiving elements.

17. The grip positioning device of claim 13, wherein the device is constructed from a plastic, polymer, silicone, rubber, cloth, or fabric type of material.

18. The grip positioning device of claim 13, wherein the thickness of the first resiliently flexible strap of the tool receptacle is the same as the thickness of each of the second resiliently flexible straps of the digit receiving elements.

19. The grip positioning device of claim 13, wherein each digit receiving element is independently pliable relative to the others.

20. The grip positioning device of claim 13, wherein the thickness of the first resiliently flexible strap of the tool receptacle is greater than the thickness of each of the second resiliently flexible straps of the digit receiving elements.

21. The grip positioning device of claim 13, further comprising a gripping material on at least one of an inner surface of the tool receptacle and inner surfaces of the digit receiving elements.

22. The grip positioning device of claim 13, wherein the cross-sectional areas of the tool opening and the finger openings are expandable and collapsible.

23. The grip positioning device of claim 13, wherein the tool opening and the finger openings are substantially coplanar.

24. The grip positioning device of claim 13, wherein the tool opening has a substantially triangular-shaped cross-section.

* * * * *